US009272756B1

(12) United States Patent
Thomson et al.

(10) Patent No.: US 9,272,756 B1
(45) Date of Patent: Mar. 1, 2016

(54) VARIABLE BUOYANCY BUOY AND DEPLOYMENT METHODS

(71) Applicants: Bret R. Thomson, San Diego, CA (US); Steve Whiteside, Jamul, CA (US); Brandon J. Wiedemeier, San Diego, CA (US); Steven J. Horstman, El Cajon, CA (US); Ronald Allen Skala, Murrieta, CA (US); George T. Stevens, IV, San Marcos, CA (US); Robert M. Lee, Campo, CA (US); Jeffrey M. Lloyd, San Diego, CA (US)

(72) Inventors: Bret R. Thomson, San Diego, CA (US); Steve Whiteside, Jamul, CA (US); Brandon J. Wiedemeier, San Diego, CA (US); Steven J. Horstman, El Cajon, CA (US); Ronald Allen Skala, Murrieta, CA (US); George T. Stevens, IV, San Marcos, CA (US); Robert M. Lee, Campo, CA (US); Jeffrey M. Lloyd, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 180 days.

(21) Appl. No.: 14/133,752

(22) Filed: Dec. 19, 2013

(51) Int. Cl.
*B63B 22/18* (2006.01)

(52) U.S. Cl.
CPC ..... *B63B 22/18* (2013.01)

(58) Field of Classification Search
CPC .. B63B 22/20; B63B 2207/02; B63B 2207/04
See application file for complete search history.

(56) References Cited

U.S. PATENT DOCUMENTS 4,054,104 A * 10/1977 Haselton ..... 114/264
4,788,925 A * 12/1988 Simon et al. ..... 114/69
6,321,676 B1 * 11/2001 Kohnen et al. ..... 114/312

* cited by examiner

*Primary Examiner* — Edwin Swinehart
(74) *Attorney, Agent, or Firm* — SSC Pacific Patent Office; Arthur K. Samora; Kyle Eppele

(57) ABSTRACT

A variable buoyancy buoy and method for deployment therefor can include a fixed buoyancy portion formed with a cavity and an enclosure. A pressure hull containing instrumentation can be place in the cavity, and a variable buoyancy portion that can be inserted into the enclosure. The fixed buoyancy portion can have a spar buoy configuration or a marker buoy configuration, and can further be formed with at least one opening to establish a path of fluid communication between the exterior of the buoy and the enclosure. The variable buoyancy portion can be a compressible bladder, or compressible foam, which can change form a maximum volume at the water surface to a minimum volume as the buoy descends towards stowage depth. The decrease in buoyancy facilitates retrieval of the buoy by an apparatus on the ocean floor.

17 Claims, 6 Drawing Sheets

VARIABLE BUOYANCY BUOY AND DEPLOYMENT METHODS

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; referencing NC 102678.

FIELD OF THE INVENTION

The present invention pertains generally to buoys. More specifically, the present invention pertains to the buoys which can have variable buoyancy for ease of deployment and power savings as the buoys are deployed.

BACKGROUND OF THE INVENTION

Moored buoys are well known in the prior art for use in various purposes, including marking navigational hazards, aids to navigation channels, etc. A moored surface buoy must have a relatively high net buoyancy to limit overtopping in higher sea states. In the case of high surface current, the high net buoyancy is needed to prevent the buoy from being drug under by the tension in the mooring.

In some instances, buoys are deployed from a ship. In other instances, it may be desired to deploy a buoy from a stowage configuration that is already underwater. Reasons for such stowage can include preventing (or at least slowing) the growth of marine growths such as kelp on the outer hull of the buoy. For these cases, a buoy could be required to ascend a water column for deployment, and descend in the water column during retraction and re-stowage. During the retraction phase, a large relative force may be required to bring it back down to the stowage structure. By adding a pressure sensitive variable buoyancy, the buoy can have the advantage of relatively large excess buoyancy at the surface, while having a significantly decreased net buoyancy at depth; thus, saving energy during descent.

In view of the above, it is an object of the present invention to provide a variable buoyancy buoy having variable buoyancy, which can be protected inside a flooded area inside the main floatation portion of the buoy. Another object of the present invention is to provide a variable buoyancy buoy that inhibits formation of marine growth on the buoy and maintains a kelp shedding aspect for the buoy. Still another object of the present invention is to provide a variable buoyancy buoy that decrease in buoyancy with increase depth in the water. Yet another object of the present invention is to provide a variable buoyancy buoy that can require decreased power to retract the buoy when the buoy is stowed underwater. Another objective of the present invention is to provide a variable buoyancy buoy, which is easy to manufacture and use in a cost-effective manner.

SUMMARY OF THE INVENTION

A variable buoyancy buoy and method for deployment therefor can include a fixed buoyancy portion formed with an enclosure and a variable buoyancy portion that can be inserted into the enclosure. The fixed buoyancy portion can be formed with at least one opening to establish a path of fluid communication between the exterior of the buoy and the variable buoyancy portion. The fixed buoyancy portion can further be formed with a cavity. A pressure vessel body containing electronics or other materials can be located within the cavity. The fixed buoyancy portion can have a spar buoy configuration or a marker buoy configuration, according to the needs of the user.

The buoy can have variable buoyancy, which can vary from maximum buoyancy at atmospheric pressure to minimum buoyancy, which can occur at stowage depth for the buoy. The variable buoyancy portion can have a variable volume, which can change from a maximum volume at the surface of the water (atmospheric pressure) to a minimum volume when the buoy is at stowage depth. To do this, the variable buoyancy portion can be a compressible bladder, or compressible foam. The variable buoyancy can facilitate the retraction of the buoy with a winch which can be located at the floor of the water body. As the winch retracts the buoy, the buoyancy can decrease as the buoy descends into the water, which can decrease the power required to retract the buoy.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
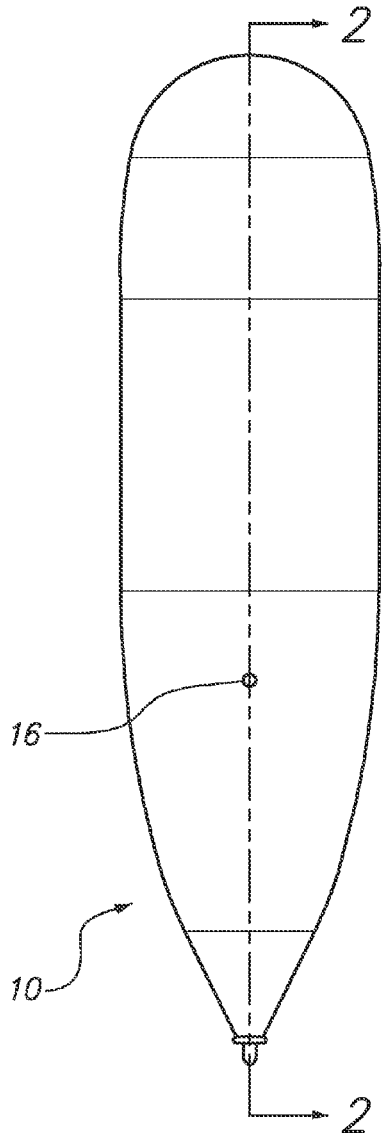
FIG. 1 is a side elevational view of a variable buoyancy buoy of the present invention according to several embodiments.

In brief overview, a moored surface buoy must have a relatively high net buoyancy to limit overtopping in higher sea states. In the case of high surface current, high net buoyancy is required to prevent the buoy from being drug under by the tension in the mooring. Thus, a buoy that is required to ascend and descend in a water column would require a large relative force to bring it back down. Additionally, the buoy can have a low profile, to maximize kelp shedding properties for the buoy (kelp shedding can be taken to refer to the ability of the buoy to move through an existing kelp forest as it ascends and descends through the water column). By incorporating pressure sensitive variable buoyancy into a buoy, the buoy can have the advantage of relatively large excess buoyancy at the surface, while having significantly decreased net buoyancy at depth; thus, saving energy during descent. This disclosure describes two passive methods that can solve this problem while keeping the outer hull of the buoy static and smooth for kelp shedding (i.e., marine growth on the buoy hull).

Referring now to FIGS. 1-4, a variable buoyancy buoy according to several embodiments of the present invention is shown and is generally designated by reference character 10. As shown in FIGS. 1-4, buoy 10 can have a fixed buoyancy portion 12. Fixed buoyancy portion 12 can be formed with an enclosure 14 (best seen in FIG. 3) and at least one opening 16, which can establish a path of fluid communication between enclosure 14 and the exterior of buoy 12.

Figure 2:
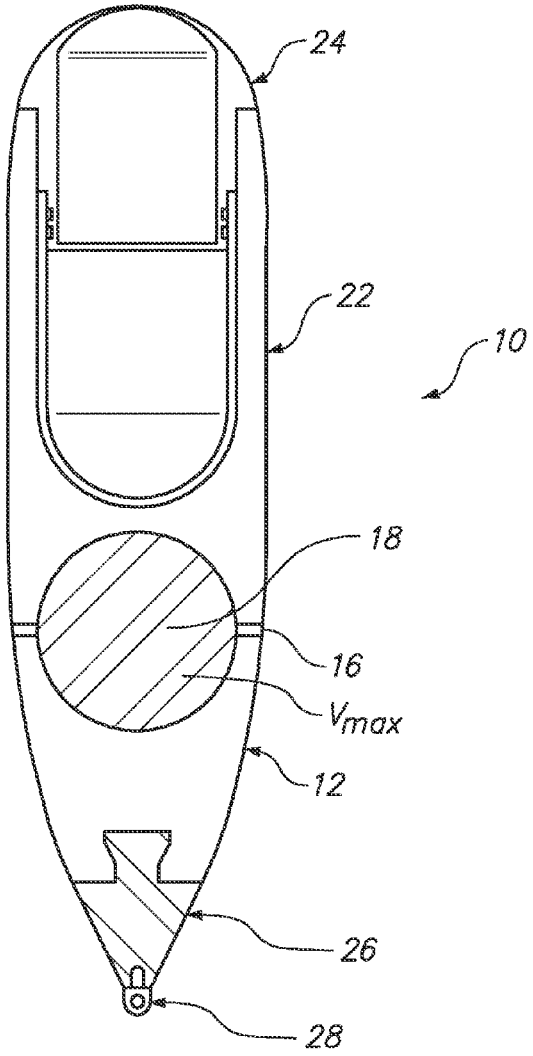
FIG. 2 is a cross-sectional view taken along line 2-2 in FIG. 1.
Figure 3:
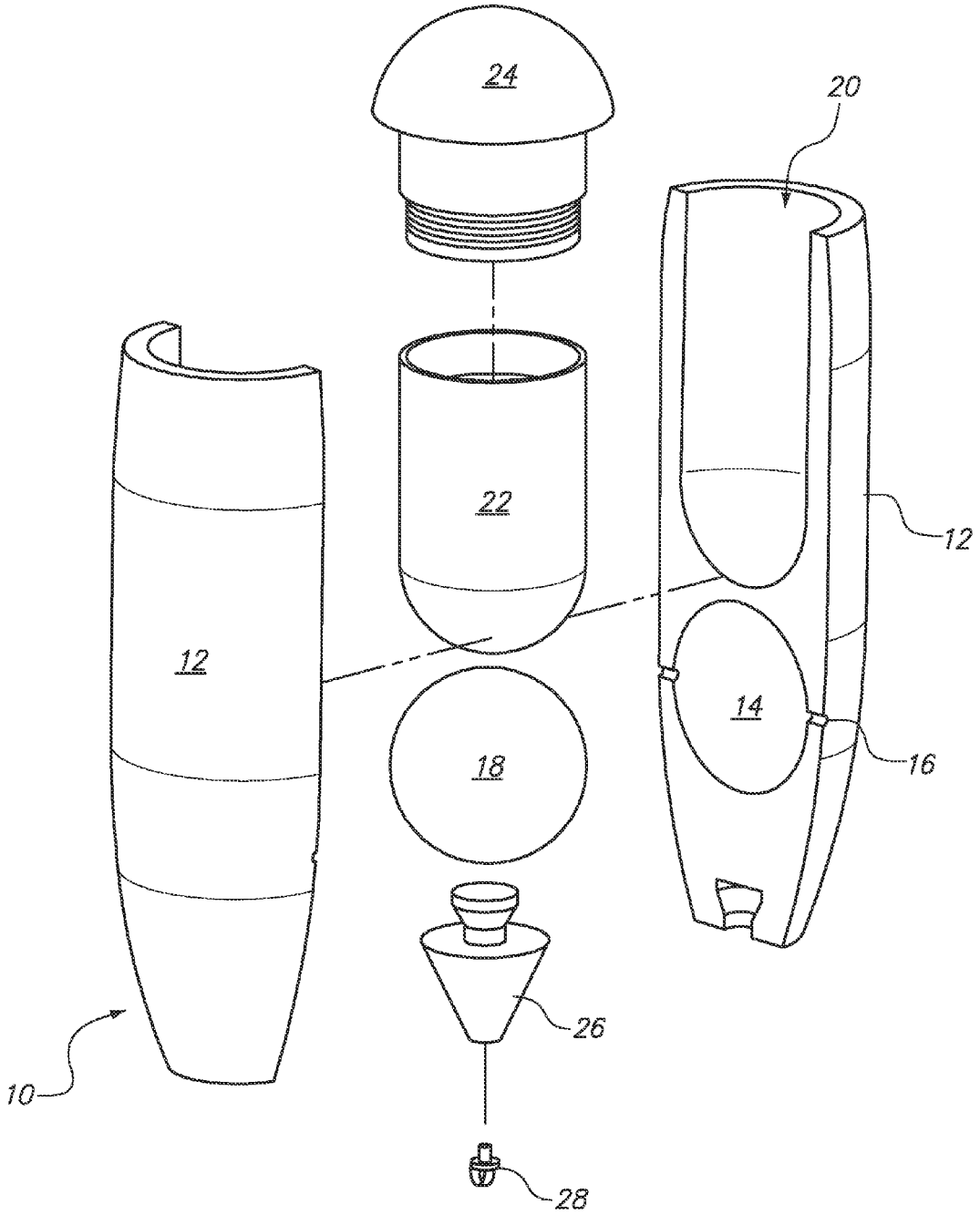
FIG. 3 is an exploded side elevational view of the buoy of FIG. 1.

As shown in FIGS. 1-4, buoy 10 can further include a variable buoyancy portion 18, which can be located within the enclosure 14 so that the fixed buoyancy portion surrounds the variable buoyancy portion. It is placed in a flooded area of the buoy hull (enclosure 14) where it can displace that area of water given surface pressure and reduce in physical size at depth due to external pressure, which can occur to the path of fluid communication between enclosure 14 and the exterior of the buoy 10. In several embodiments, the variable buoyancy portion can be a bladder. In other embodiments, the variable buoyancy portion can be made of a closed cell foam material. Given a net internal pressure approximately equal to surface pressure, the bladder will then be compressed by additional static pressure at depth as described below. In FIGS. 2 and 3, the variable buoyancy portion 18 is depicted as being spherical, but the variable buoyancy portion does not have to be spherical, it could have geometry which can be adjusted to the shape of the formed enclosure 14.

In still other embodiments, and as mentioned above, variable buoyancy portion 18 can be made of low density contracting closed cell foam which is resistant to compression set. It can be shown that an appropriate closed cell foam can survive the depths without becoming waterlogged or losing its uncompressed shape once the variable buoyancy portion 18 is returned to the surface. Thus, it can increase the buoyancy of the buoy at the surface and will then lose its volume as it is compressed at depth and repeat the cycle irrespective of soak time or number of cycles. Other methods of variable buoyancy can include active expansion of a chamber via regulated pressure or mechanical sliding of a pressure vessel with relative vacuum.

Figure 7:
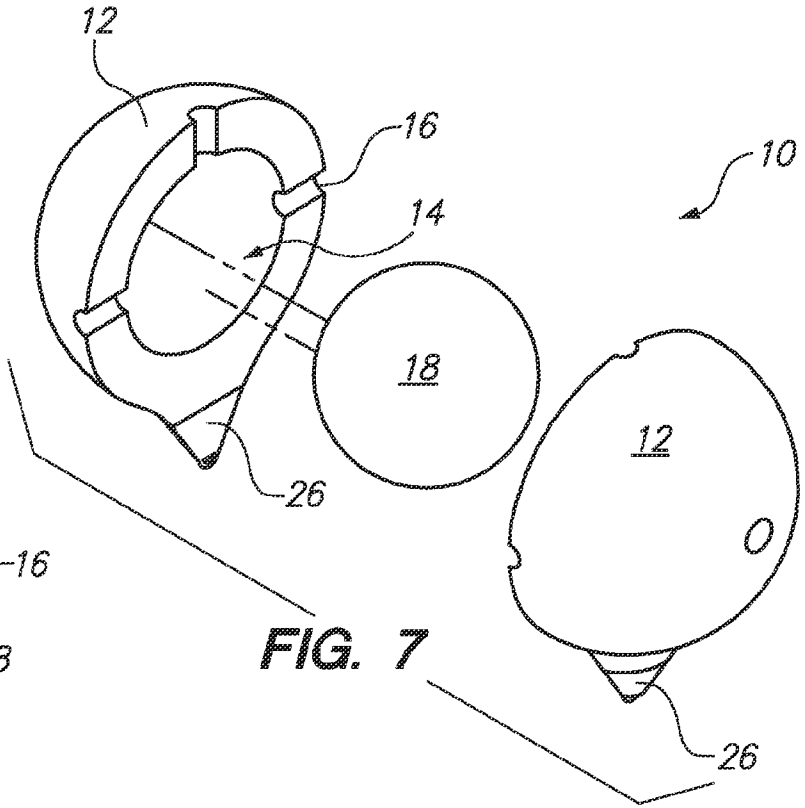
FIG. 7 is an exploded side elevational view of the buoy of FIG. 5.
Figure 6:
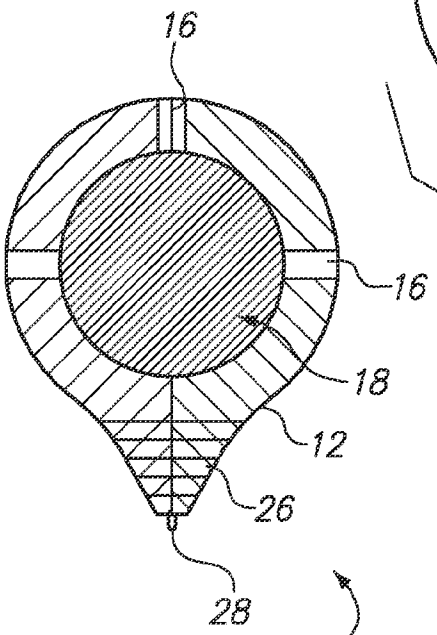
FIG. 6 is a cross-sectional view taken along line 6-6 in FIG. 5.

As shown in FIGS. 2-3, fixed buoyancy portion 12 of buoy 10 can be formed with a cavity 20, and a pressure vessel body 22 can be placed into cavity 20 and secured with cap 24. Instrumentation, electronics and similar structure which accomplishes the intended purpose of the buoy 10 can be enclosed within body 22 and can thereby be protected. At the opposite end of buoy 10 from cavity 20, a ballast 26 can be attached to fixed buoyancy portion 12 and a hook 28 can be attached to ballast 26, which, when combined with tether 30 (See FIG. 8), can facilitate the deployment and retrieval of the buoy 10, as described more fully below. As shown in FIGS. 1-4, fixed buoyancy portion 12 can have a spar configuration, but a spherical configuration (typically used for a marker buoy) can also be used, as shown in FIGS. 5-7. Other geometries for buoy 10 can also be used without departing from the scope of the present invention.

Figure 4:
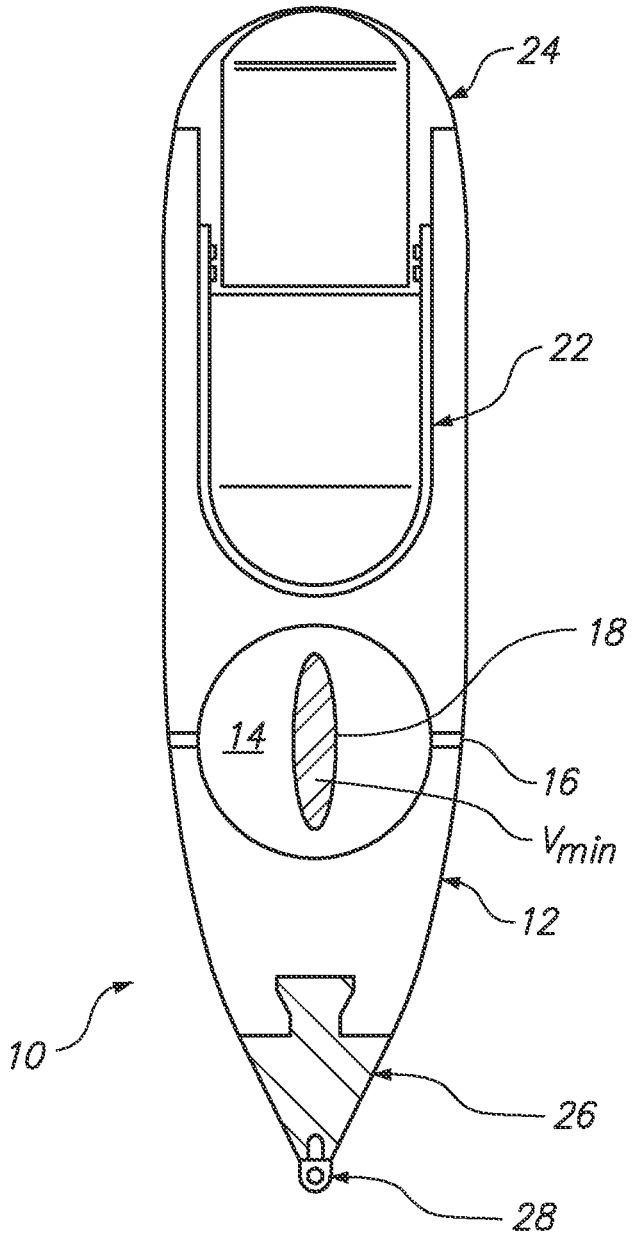
FIG. 4 is the same view as FIG. 2, but when the variable buoyancy portion has a minimum volume.
Figure 5:
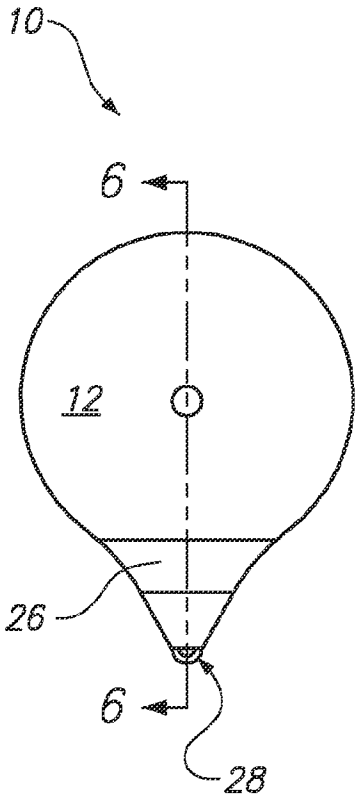
FIG. 5 is a side elevational view of a variable buoyancy buoy of the present invention according to several alternative embodiments.
Figure 8:
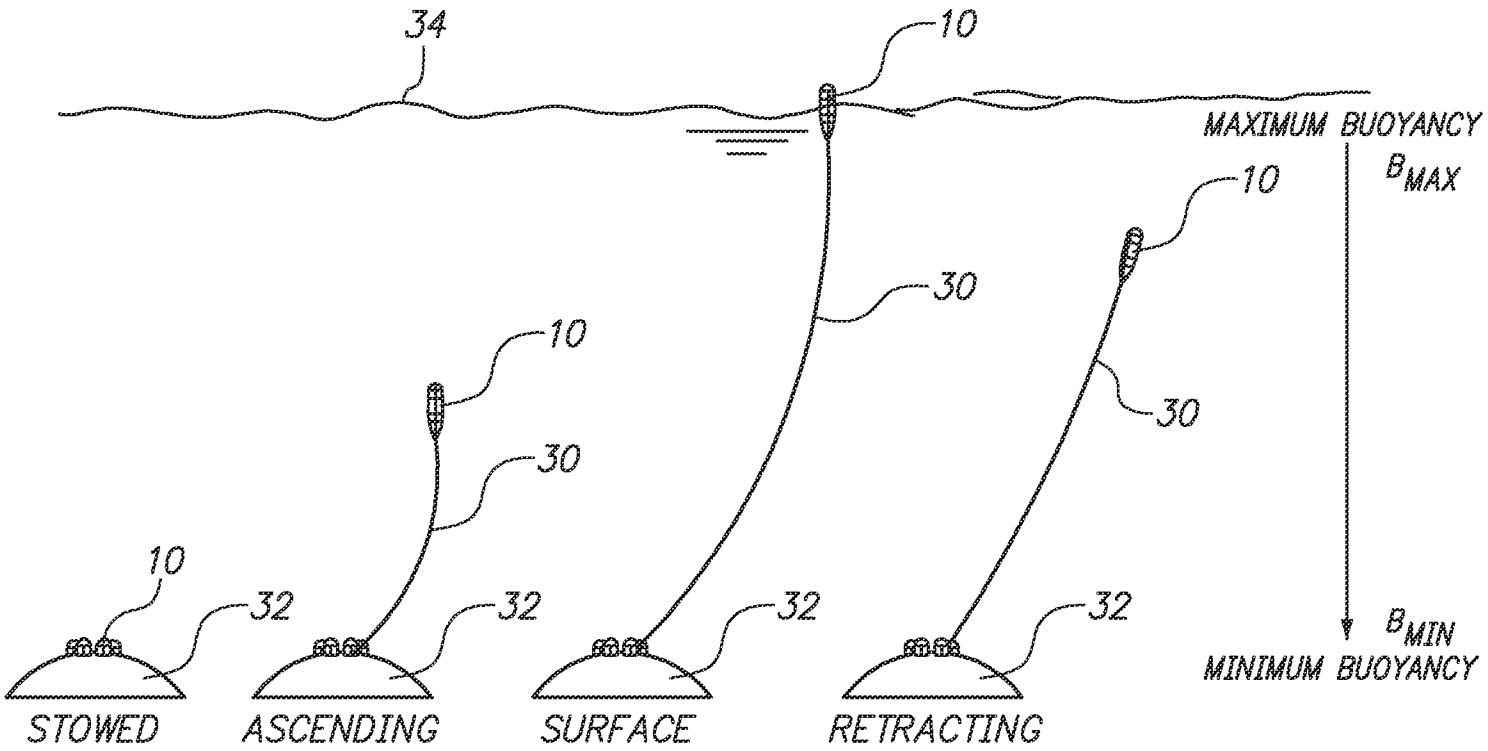
FIG. 8 is an illustration of the buoy of FIG. 1 at various points in the deployment and retrieval cycle; and, FIG. 9 is a block diagram, which illustrates steps that can be taken to accomplish the methods of the present invention according to several embodiments.

Referring now to FIGS. 2, 4 and 8, the deployment cycle of the buoy 10 can be depicted. As shown, the buoy 10 can typically in a stowage position at a docking station 32, which can typically be on the ocean floor or underwater at a maximum depth for the buoy 10. In the stowage position, the variable buoyancy portion 18 can have a minimum volume $V_{min}$ and corresponding minimum buoyancy $B_{min}$, as depicted by FIGS. 4 and 8. This stowed configuration can be advantageous, in that it could be resistant to tampering, and also that it can be less likely to be disturbed by fishing activities (such as trawling or netting) and boat traffic. Thus, this configuration can offer less exposure to man-made hazards or theft. For deployment, buoy 10 can ascend toward the surface 34 of the water. As this occurs, the volume V of variable buoyancy portion 18 increases, which can increase the corresponding buoyancy B of the buoy.

When buoy 10 is on the surface 34 of the water, the variable buoyancy portion has a maximum volume $V_{max}$ and buoy 10 has corresponding maximum buoyancy $B_{max}$. Once the desired mission of the buoy 10 has been accomplished, the operator can selectively retract buoy 10 using a winch (not shown in FIG. 8) towards docking station 32. Or, the buoy could retract/be released according to a timer on docking station 32, or it can be triggered by acoustics from the nearby surface craft or underwater craft, or by other autonomous means.

Based on depth, the buoy will change net buoyancy. Because of the variable buoyancy (due to compressible volume and displacement by water) of variable buoyancy portion 18, the buoy net buoyancy B can decrease with depth making the net force required to retract the buoy 10 (i.e., the tension force on tether 30) decrease.

As an illustrative case of the above, and given a bladder or closed cell foam is used, the buoy will decrease its variable buoyancy by half every time the external pressure doubles to an increase in depth of the buoy 10, for example:

Surface (1 atmosphere, ATM)=6 lb variable buoyancy; total buoyancy=12 lb 33 ft (2 ATM)=3 lb variable buoyancy; total buoyancy=9 lb 100 ft (4 ATM)=1.5 lb variable buoyancy; total buoyancy=7.5 lb 233 ft (8 ATM)=0.75 lb variable buoyancy; total buoyancy=6.75 lb 500 ft (16 ATM)=0.37 lb variable buoyancy; total buoyancy=6.37 lb Given the net buoyancy of a buoy is 12 lb at the surface ($B_{max}$=12 lb), and 6 lbs of that buoyancy is variable, as buoy 10 descends it will decrease in net buoyancy as the variable buoyancy is compressed and the net buoyancy approaches the fixed buoyancy ($B_{min}$), which in this case is 6 lb. The available change in buoyancy can be based on the depth at which the buoy 10 will be stowed and the available compressible volume V of variable buoyancy portion 18 which can be displaced by water/seawater.

Form the above, it can be seen that the force required for retraction of the buoy can decrease significantly which in turn can save energy for the winch. Since the retraction mechanism power is typically provided by batteries, this can be extremely desirable, as the retraction mechanism can often be at depth (in the example above, at 500 ft) that can make it extremely difficult to replace the batteries. Thus, power needed to deploy the variable buoyancy buoy is decreased, and reliability of the system is increase (typically batteries) in a retractable buoy system. The excess buoyancy is thus greatest on the surface where it is needed for wave following and stability concerns. The fixed buoyancy is reserved as a minimum for what the buoy would need to overcome stowed forces, and maintain its shape for shedding possible obstacles such as seaweed, and to avoid the situation where the buoy does not reach the surface given the line weight or due to water current blow down.

The advantage of this invention according to several embodiments can be its simple and passive nature. Either embodiment of variable buoyancy portion 18, whether foam or bladder, is capable of compressing and re-expanding reliably without any activation or electronics overhead. Since variable buoyancy portion 18 is simply constructed and occupies a flooded pocket (enclosure 14) in the hull of the buoy, it can be unlikely to become fouled or damaged by obstacles normally encountered by the buoy during its ascent or descent. However, it is conceivable that the variable buoyancy portion 18 can be external, such as a float ring, if kelp is not an issue. Finally, because there is no seal to leak, they are well suited for long term use and a high number of cycles.

This invention can further be envisioned for use with Unmanned Underwater Vehicles (UUV's) that require surface operation as part of their mission. The variable buoyancy portion 18 would become more buoyant near the surface, thus allowing for RF or other communications without requiring the UUV to be actively driving upward to maintain surface operation. Once the UUV is finished, and it dives to a specified depth, it can then become near neutral again so it would not expend extra energy to maintain its depth. Thus the UUV could have a hybrid operation (spending part of its mission as a buoy and part as a roaming vehicle, more efficiently. Also, surfacing for pickup, if it is required, would be made easier as more of the vehicle would be visibly out of the water and sit higher for attaching an arresting hook or other method of capture.

Figure 9:
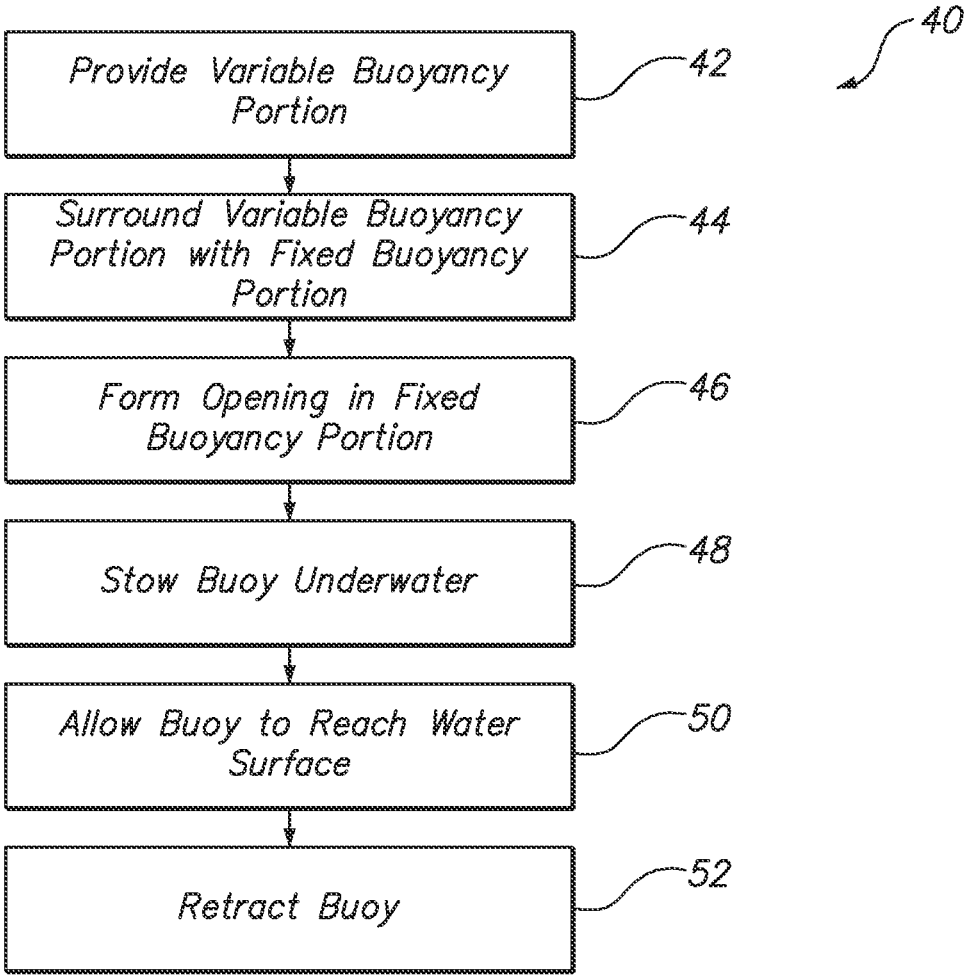

Referring now to FIG. 9, a block diagram that can depict the methods of the present invention for deploying a variable buoyancy buoy according to several embodiments is shown and annotated by reference character 40. As shown, a method 40 can include the initial step 42 of providing a variable buoyancy portion 18 for the buoy. The variable buoyancy portion 18 can have the structure of the embodiments discussed above. The methods 40 can further include the step of surrounding the variable buoyancy portion 18 with a fixed buoyancy portion 12, as shown by block 44 in FIG. 9. The methods can include (box 46) the step of forming an opening 16 in the fixed buoyancy portion. This can establish a path of fluid communication from the exterior of the fixed buoyancy portion 12 to the variable buoyancy portion 18, which can allow for a pressure force to be exerted on the variable buoyancy portion 18 when the buoy 10 is placed in the water.

As shown in FIG. 9, the methods 40 can further include the step 48 of stowing the buoy underwater, using a docking station 32 as described above, or other means. When in a stowage position, the buoy 10 has minimum buoyancy $B_{min}$, but $B_{min}$ is still sufficient to cause buoy 10 to rise once released from docking station 32. For deployment, the buoy 10 can be released and allowed to float to the surface, as indicated by step 50 in FIG. 9. Once buoy 10 is at surface 34 of the water, buoy 10 has maximum buoyancy $B_{max}$ and variable buoyancy portion 18 has a maximum volume $V_{max}$. As desired by the operator, the buoy can be retracted, as indicated by step 52 in FIG. 9. As this occur, the volume V begins to decrease and seawater begins to displace the volume of variably buoyancy portion 18, which can decrease the force on tether 30 that can be required to the retract the buoy 10. This can continue until the buoy is at depth and stowed at docking station 32, at which time variable buoyancy portion 18 have minimum volume $V_{min}$ and buoy 10 again has minimum buoyancy $B_{min}$. The process can then be repeated as desired by the operator.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A buoy having an exterior, said buoy comprising:

a fixed buoyancy portion formed with an enclosure;

a variable buoyancy portion inserted into said enclosure so that said fixed buoyancy portion surrounds said variable buoyancy portion;

said fixed buoyancy portion being formed with at least one opening to establish a path of fluid communication between the exterior of said buoy and said variable buoyancy portion;

an underwater docking station; and, a tether connecting said fixed buoyancy portion to said underwater docking station.

2. The buoy of claim 1, wherein said fixed buoyancy portion is formed with a cavity, and further comprising a pressure vessel body located within said cavity.

3. The buoy of claim 1 wherein said variable buoyancy portion has a variable volume, a maximum volume and a minimum volume, and further wherein said minimum volume occurs when said fixed buoy is stowed at said docking station.

4. The buoy of claim 1 wherein said variable buoyancy portion is a compressible bladder.

5. The buoy of claim 1 wherein said variable buoyancy portion is made of compressible foam.

6. The buoy of claim 1 wherein said fixed buoyancy portion has a spar buoy configuration.

7. The buoy of claim 1 wherein said fixed buoyancy portion has a marker buoy configuration.

8. A buoy, comprising:

a variable buoyancy portion;

a fixed buoyancy portion surrounding said variable buoyancy portion;

said fixed buoyancy portion being formed with at least one opening to allow for water to pass through said fixed buoyancy portion and contact said variable buoyancy portion;

an underwater docking station; and, a tether connecting said fixed buoyancy portion to said underwater docking station.

9. The buoy of claim 8, wherein said fixed buoyancy portion is formed with a cavity, and further comprising a pressure vessel body located with said cavity.

10. The buoy of claim 8, wherein said buoy is formed with a cavity, and further comprising a pressure vessel body located within said cavity.

11. The buoy of claim 8 wherein said variable buoyancy portion has a variable volume, a maximum volume and a minimum volume, and further wherein said minimum volume occurs when said buoy is stowed at said docking station.

12. The buoy of claim 8 wherein said variable buoyancy portion is a compressible bladder.

13. The buoy of claim 8 wherein said variable buoyancy portion is made of compressible foam.

14. The buoy of claim 8 wherein said fixed buoyancy portion has a spar buoy configuration.

15. A method for deploying a buoy, comprising the steps of:

A) providing a variable buoyancy portion;

B) surrounding said variable buoyancy portion with a fixed buoyancy portion; and, C) forming with at least one opening in said fixed buoyancy portion to allow for water to pass through said fixed buoyancy portion and contact said variable buoyancy portion D) stowing said buoy underwater at a docking station, said buoy having a minimum buoyancy $B_{min}$, when said buoy is stowed; and, E) releasing said buoy from said docking station, said $B_{min}$ being sufficient for said buoy to rise upon accomplished of said releasing step.

16. The method of claim 15, wherein said step A) is accomplished using a variable buoyancy portion selected from the group consisting of a compressible bladder and compressible foam.

17. The method of claim 15, wherein said step B) is accomplished using a fixed buoyancy portion having a configuration selected from the group consisting of a spar buoy and a marker buoy.

* * * * *